US009365967B2

(12) United States Patent
Hering et al.

(10) Patent No.: US 9,365,967 B2
(45) Date of Patent: Jun. 14, 2016

(54) HOUSEHOLD APPLIANCE, IN PARTICULAR A HOUSEHOLD DISHWASHING MACHINE

(75) Inventors: Reinhard Hering, Holzheim (DE); Michael Georg Rosenbauer, Reimlingen (DE)

(73) Assignee: BSH Hausgeräte GmbH, Munich (DE)

( * ) Notice: Subject to any disclaimer, the term of this patent is extended or adjusted under 35 U.S.C. 154(b) by 1072 days.

(21) Appl. No.: 13/497,804

(22) PCT Filed: Sep. 24, 2010

(86) PCT No.: PCT/EP2010/064091

§ 371 (c)(1),
(2), (4) Date: Mar. 23, 2012

(87) PCT Pub. No.: WO2011/045158

PCT Pub. Date: Apr. 21, 2011

(65) Prior Publication Data

US 2012/0186615 A1 Jul. 26, 2012

(30) Foreign Application Priority Data

Oct. 12, 2009 (DE) ..... 10 2009 045 593

(51) Int. Cl.

| | |
|---|---|
| ***D06F 39/00*** | (2006.01) |
| ***A47L 15/00*** | (2006.01) |
| ***A47L 15/46*** | (2006.01) |
| ***D06F 33/02*** | (2006.01) |
| ***F24C 7/08*** | (2006.01) |
| *A47L 15/42* | (2006.01) |

(52) U.S. Cl.

CPC ..... *D06F 39/005* (2013.01); *A47L 15/0047* (2013.01); *A47L 15/46* (2013.01); *D06F 33/02* (2013.01); *F24C 7/082* (2013.01); *A47L 15/4293* (2013.01); *A47L 2401/03* (2013.01); *A47L2401/20* (2013.01); *A47L 2501/28* (2013.01); *A47L 2501/32* (2013.01); *D06F 2216/00* (2013.01)

(58) Field of Classification Search

CPC ..... A47L 2401/03; A47L 2401/20; A47L 2501/28; A47L 2501/32; A47L 15/46; A47L 15/0047; A47L 15/4293; F24C 7/082; D06F 39/005; D06F 2216/00; D06F 33/02

See application file for complete search history.

(56) References Cited

U.S. PATENT DOCUMENTS

| | | | | | |
|---|---|---|---|---|---|
| 3,790,815 | A * | 2/1974 | Karklys | G05B 19/07 | 134/57 D |
| 4,245,309 | A * | 1/1981 | Kiefer | G05B 19/0426 | 134/57 D |
| 6,369,629 | B1 * | 4/2002 | Sato | H03K 3/35625 | 326/98 |
| 2010/0262315 | A1 | 10/2010 | Rosenbauer | | |

FOREIGN PATENT DOCUMENTS

| | | | | |
|---|---|---|---|---|
| AT | EP 0261541 | * | 3/1988 | H02H 11/00 |
| DE | 4321101 | * | 1/1995 | F24C 7/082 |
| DE | 4321101 | A1 | 1/1995 | |
| DE | 19624890 | A1 | 8/1997 | |
| EP | 0261541 | A1 * | 3/1988 | H02H 11/00 |
| EP | 1674797 | A2 | 6/2006 | |

OTHER PUBLICATIONS

International Search Report PCT/EP2010/064091.

* cited by examiner

*Primary Examiner* — Karla Moore
*Assistant Examiner* — Tinsae Ayalew
(74) *Attorney, Agent, or Firm* — James E. Howard; Andre Pallapies

(57) ABSTRACT

A household appliance includes an operating display unit having at least one visual and/or acoustic display to at least display and/or signal a completed treatment cycle, and an actuatable switching unit configured to activate and deactivate the household appliance. An on switch is provided to generate an activation signal for actuating the switching unit to thereby activate the household appliance, and a control device is provided to generate a deactivation signal for actuating the switching unit when a treatment cycle is completed and to thereby deactivate at least the display unit.

17 Claims, 2 Drawing Sheets

HOUSEHOLD APPLIANCE, IN PARTICULAR A HOUSEHOLD DISHWASHING MACHINE

BACKGROUND OF THE INVENTION

The invention relates to a household appliance, in particular a household dishwasher, at least having an operating display with at least one visual and/or acoustic display means, which is configured at least to display and/or signal a completed treatment cycle.

When consumer organizations rate household appliances, the energy consumption of the household appliance, in particular also its annual energy balance sheet, plays a significant role. Household appliances have an operating display with at least visual display means, for example LEDs, which can be used during the operation of the household appliance to display operating parameters, etc. and after completion of a treatment cycle according to a program to indicate that the treatment cycle has been completed. However after the end of the program the household appliance remains connected to the power supply network until the customer actively intervenes and deactivates the household appliance by actuating the main switch.

BRIEF SUMMARY OF THE INVENTION

The object of the invention is to provide a household appliance, in particular a household dishwasher, with which energy consumption is further reduced.

According to the invention provision is made for it to be possible to activate and deactivate the household appliance by means of an actuatable switching means and for it to be possible by means of an on switch to generate an activation signal actuating the switching means in order to activate the household appliance and for the household appliance to have a control device, by means of which a deactivation signal actuating the switching means can be generated when a treatment cycle is completed, in order to deactivate at least the display means. The invention is based on the knowledge that the energy consumption of the household appliance due to the electrical operation of the visual display means has a tangible effect on the annual energy balance sheet. The invention allows the visual display means to be deactivated automatically independently of actuation of a main switch for example. Such deactivation of the display means can take place when its operation is classed as not necessary by a control device for example. Tests have shown that the time period between completion of the actual treatment cycle and a following treatment cycle can be in the region of hours or days. If the main switch is not deactivated after the end of the treatment cycle, the visual display means in particular, which indicate the end of the program, then remain activated until the following treatment cycle. The energy consumption of the household appliance can thus be tangibly increased in the annual energy balance sheet. Against this background the energy consumption of the appliance after the end of a treatment cycle can be significantly reduced so that the overall energy consumption of the household appliance is correspondingly reduced. The actuatable switching means here can be a relay, a contactor, a bistable relay or a semiconductor relay for example.

Provision is preferably made for the switching means to have at least one self-holding contact circuit, which is connected for signal transmission purposes at least to the on switch and the control device. The self-holding contact circuit allows at least the display means or the household appliance per se to be isolated from a household power supply network after the end of a wash program, in order thus to reduce energy consumption.

The self-holding contact circuit can preferably have at least one on switch. This can be embodied as a push button, which is open in the unactuated state and closes electrical contact points when actuated. The on switch can be actuated by an operator in the manner of a microswitch in the control panel of the household appliance and can be connected parallel to the abovementioned switching element. However other switches can also be used, such as infrared buttons, proximity switches, capacitive buttons or piezo buttons for example. The on switch here is preferably configured so that it can be operated by an operator, so that an operator can activate the household appliance.

Provision is preferably made for it to be possible for the control device to deactivate the operating display. Energy consumption can thus be further reduced, as the entire operating display is isolated from the energy supply as well as the visual and/or acoustic displays. The deactivation signal to deactivate the visual display means, etc. can be generated immediately after a completed treatment cycle of the household appliance. The deactivation signal is preferably generated automatically by a control device, which can be used during a treatment cycle to actuate appliance components such as the display means or circulating/drain pumps for example. Alternatively the deactivation signal can be generated by a sensor device, which for example detects the opening of the appliance door after the end of a treatment cycle and then generates the deactivation signal.

Provision is also preferably made for it to be possible for the control device to deactivate the household appliance. This reduces the energy requirement again, as further appliance components are thus isolated from the energy supply.

In addition to the automatic generation of the deactivation signal immediately after the end of the treatment cycle, it is preferably also possible for the deactivation signal to be generated for an interruption, for example as requested by a user, of an ongoing treatment cycle.

Provision is also preferably made for it to be possible to generate an activation signal in the control device by actuating the on switch, to connect the household appliance to a power supply network when the household appliance is isolated from the power supply network. This allows activation of a completely power-free household appliance. This allows standby losses to be reduced further.

Provision is preferably made for it to be possible to generate a deactivation signal by subsequent actuation of the on switch. Such an interruption, as requested by the user, can be detected by the control device. If for example, after actuation of the abovementioned on switch, the control device detects further actuation of the on switch on the part of the user, this is classed by the control device as a user request to interrupt the ongoing treatment cycle so the control device generates a deactivation signal.

Provision is also preferably made for the on switch and off switch to be connected in a parallel manner. The power supply network can be in contact for example with an on switch configured as a microswitch and the switching element connected parallel to this. When the household appliance is out of operation, both the on switch and the switching element are open. Actuation by pressing of the microswitch allows the deactivated, i.e. open, switching element of the self-holding contact circuit to be bridged, with the result that a voltage pulse is applied to the control device. The voltage pulse is directed by way of the control device to the self-holding contact circuit, with the result that the self-holding contact circuit closes the switching element. This allows current from the network to flow by way of the now closed switching element to the self-holding contact circuit so that the switching element remains closed in a stable manner, while the on switch is opened again. As soon as the control device directs the deactivation signal to the self-holding contact circuit, said circuit opens the switching element, causing the power supply into the household appliance to be interrupted.

Provision is preferably made here for an equally high electrical voltage to be present at the on switch and the off switch. This allows a particularly simple structure.

Provision is preferably made here for the on switch and the off switch to be connected to the control device in such a manner that an activation and/or deactivation pulse is transmitted. Provision is preferably also made for the power supply unit to be disposed in such a manner that it forms a series circuit with the on switch and the off switch. Provision is also preferably made for the control device to be connected to the power supply unit in such a manner that it can be supplied with electrical energy. Provision is furthermore preferably made for the operating display to be connected to the power supply unit in such a manner that it can be provided with electrical energy. Finally provision is preferably made for the self-holding contact circuit to be assigned to a controller that can be actuated by the control device.

The self-holding contact circuit can preferably have a bistable relay, to which a relay contact acting as a switching element can be connected. Such a bistable relay is primarily characterized by the attribute that in the power-free state it can adopt two different stable switching states. A relay contact of the bistable relay can also be connected as a switching element in the main supply line of the household appliance. When the deactivation signal is applied to the bistable relay, it switches the relay contact from a stable power-free open state to a stable power-free closed state or vice versa, with the result that the household appliance is decoupled completely from the network or connected to it. A flipflop, in particular an RS flipflop, can be used instead of a relay.

Finally provision is preferably made for the self-holding contact circuit to be connected to the off switch in such a manner that the off switch can be switched to an open state so that isolation from the supply voltage is possible in a simple manner.

BRIEF DESCRIPTION OF THE DRAWINGS

An exemplary embodiment of the invention is described in more detail below with reference to the accompanying figures, in which.

DETAILED DESCRIPTION OF EXEMPLARY EMBODIMENTS OF THE PRESENT INVENTION

Figure 1:
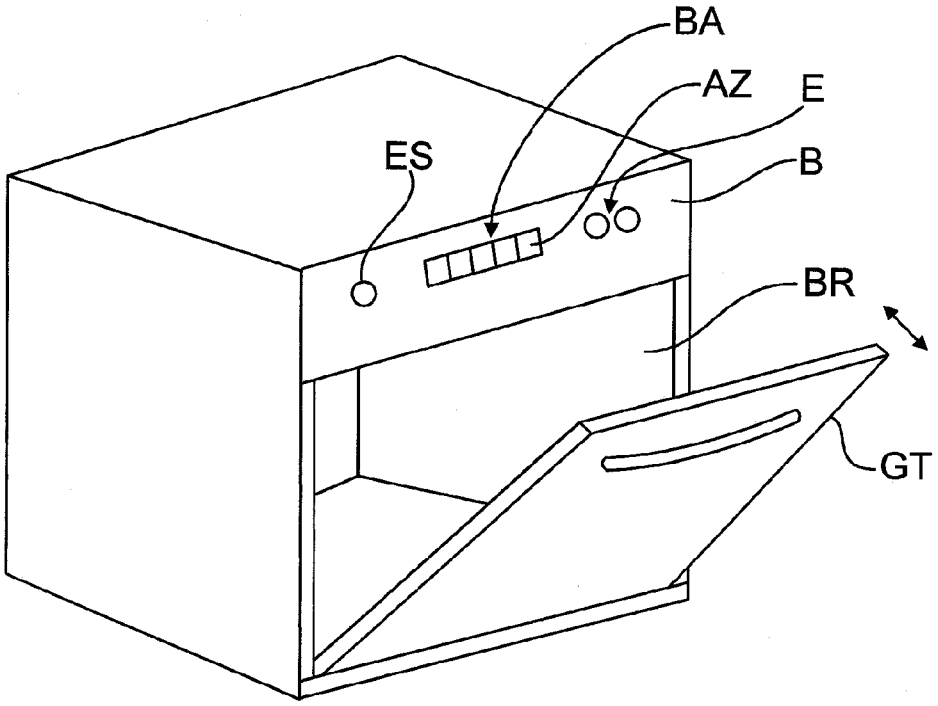
FIG. 1 shows a schematic perspective view of a household dishwasher.

FIG. 1 shows an exemplary embodiment of a household appliance in the form of a household dishwasher with a front appliance door GT, which can be pivoted in the known manner about a horizontal pivot axis at the bottom and with which a loading opening of the wash compartment BR can be opened or closed for loading and/or unloading. The loading opening is bounded at the top by a control panel B, which holds a microswitch ES and (simply indicated) visual display means AZ of an operating display BA. Input means E are also provided, which can be used to input operating parameters for a wash cycle of the household dishwasher.

The microswitch ES provided in the left region of the control panel B in FIG. 1 is configured here as a pushbutton switch for example. Actuation by pressing of the microswitch ES allows the household dishwasher to be switched to operation readiness, while subsequent actuation by pressing decouples the household dishwasher from the power supply network.

Figure 2:
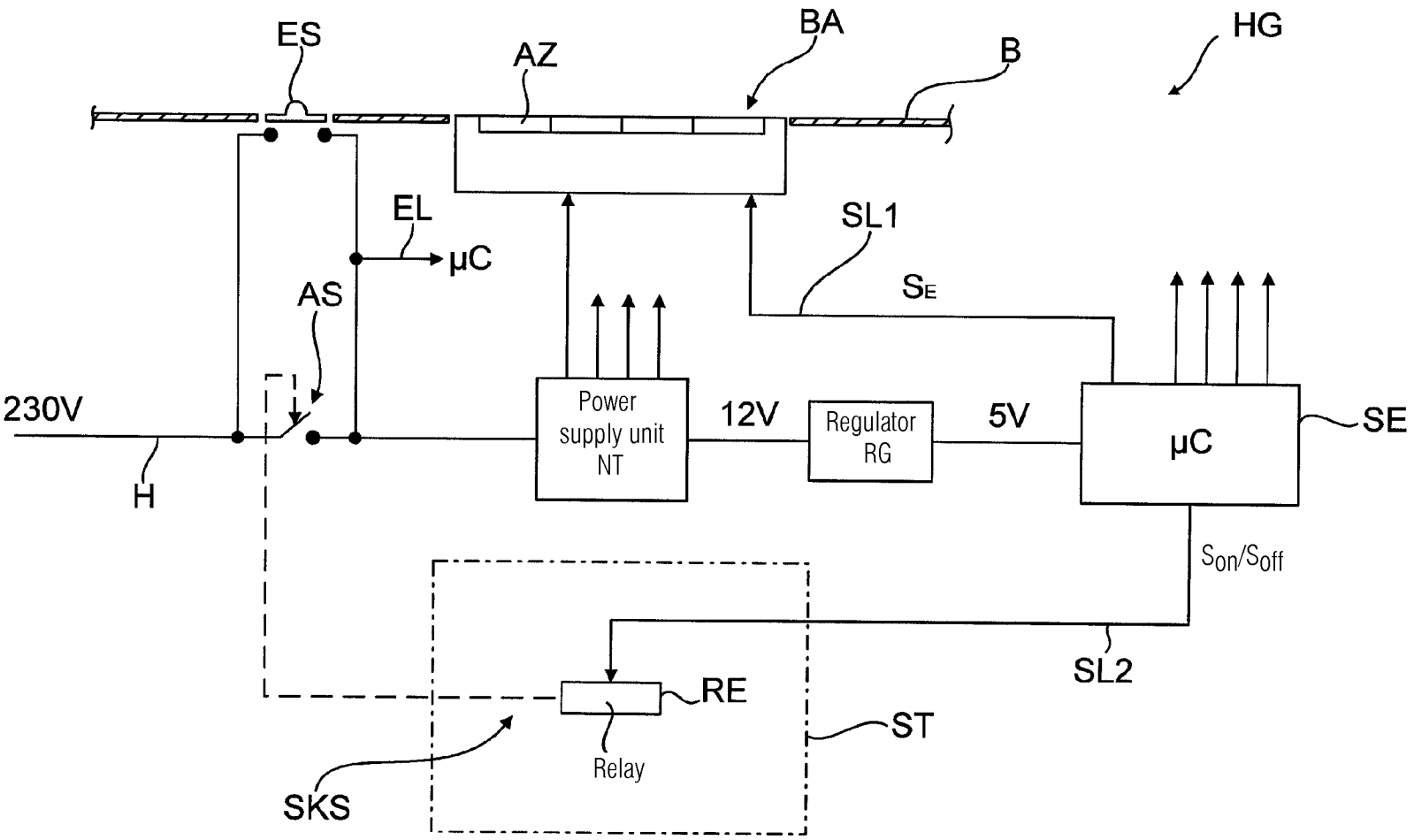
FIG. 2 shows a circuit arrangement of the household dishwasher.

FIG. 2 shows a circuit arrangement, in which the microswitch ES and the operating display BA by way of example are integrated. In the circuit arrangement shown the household dishwasher is connected by way of a main supply line H to the power supply network. Connected in series in the main supply line H are a switching element AS (described below) and a power supply unit NT.

The power supply unit NT converts the network voltage of for example 230 V to a low voltage of 12 V. The low voltage 12V is converted by means of a regulator RG connected in series downstream of the power supply unit NT to a low voltage of 5 V, which is supplied to a control device SE. The power supply unit NT also supplies other appliance components and also the operating display BA of the household dishwasher with low voltage by way of additional outputs.

The control device SE is integrated in a control module (not shown in detail) and during the execution of a wash program actuates the visual display means AZ of the operating display BA and further appliance components, for example the drain pump or the circulating pump, by means of control signals $S_E$ by way of a first signal line SL1.

As also shown in FIG. 2, the control device SE is connected by way of a second signal line SL2 to a bistable relay RE of a self-holding contact circuit SKS. The abovementioned switching element AS, which is connected in the main supply line H instead of a mechanical main switch and as such takes on a main switch function, which can be used to decouple the household dishwasher from the power supply network or connect it to it, is assigned to the bistable relay RE as a relay contact.

When the household dishwasher is out of operation both the microswitch ES and the switching element AS are open. The deactivated household dishwasher is brought into operation by actuation by pressing of the microswitch ES, causing the initially still open switching element AS to be bridged. The actuation by pressing of the microswitch ES causes a voltage pulse to be supplied, which is directed by way of the power supply unit NT and by way of the regulator RG to the control device SE.

The control device SE then forwards an activation signal $S_{on}$ to the bistable relay RE causing its relay coil to attract and the switching element AS to be switched from the power-free stable open state to an equally power-free stable closed state. This causes the microswitch ES, which after actuation by pressing is again open, to be bridged by the now closed switching element AS, with the result that the network voltage is present at the power supply unit NT.

The household dishwasher is therefore switched to operation readiness so that a wash program can then be started by means of the input means E. After the end of the wash cycle, the control device SE deactivates the appliance components, for example the drain pump or circulating pump.

Immediately after completion of the wash program the control device SE also generates a further voltage pulse, which as a deactivation signal $S_{off}$ by way of the second signal line SL2 actuates the bistable relay RE. The relay RE then switches the switching element AS from the closed position to the open position, with the result that the household dishwasher is completely isolated from the power supply network.

The switching element AS of the relay RE therefore operates as a main switch which automatically isolates the power supply unit NT of the household dishwasher from the power supply network after the end of the wash program. This means that after the end of the program a supply of power by way of the power supply unit NT to the visual display means AZ of the operating display BA in particular is also interrupted. After completion of the wash program there is therefore no energy-consuming visual display in the operating display BA of the program end.

As also shown in FIG. 2, the microswitch ES is connected directly to the control device SE for signal transmission purposes by way of an input line EL. The voltage pulse supplied when the microswitch ES is actuated manually by pressing is therefore directed directly to the control device SE, which detects and analyzes the pulse.

On detection of such a voltage pulse the control device SE checks whether the power supply unit NT is already activated when the microswitch ES is activated by pressing. If the power supply unit NT is not yet activated, the control device SE identifies activation actuation by the user and uses the activation signal $S_{on}$, as described above, to actuate the relay RE. If the power supply unit NT is already activated, the control device SE identifies a deactivation actuation by the user from the actuation by pressing of the microswitch, so the control device SE directs a corresponding deactivation signal $S_{off}$ to the relay RE. The household dishwasher is then taken out of operation. Any ongoing wash program is therefore interrupted.

LIST OF REFERENCE CHARACTERS

ES On switch
AS Off switch
H Main supply line
B Control panel
AZ Display means
BA Operating display
EL Input line
RG Regulator
SE Control device
RE Bistable relay
SKS Self-holding contact circuit
ST Controller
HG Household appliance
SL1, SL2 Signal lines
BR Treatment compartment

The invention claimed is:

1. A household appliance, comprising:

an operating display unit having at least one visual and/or acoustic display configured to at least display and/or signal a completed treatment cycle;

an actuatable switching unit configured to activate and deactivate the household appliance, the switching unit being movable between a closed position directly connected to a main voltage supply and an open position disconnected from the main voltage supply;

an on switch configured to move between a closed position in direct connection with the main voltage supply and an open position disconnected from the main voltage supply;

a power supply unit; and a control device (1) configured to, when the on switch is initially moved to the closed position, generate an activation signal for actuating the switching unit to thereby move the switching unit to the closed position to activate the household appliance; and (2) configured to generate a deactivation signal to disconnect the switching unit from the main voltage supply when a treatment cycle is completed and to thereby deactivate at least the display unit;

wherein:

the control device is configured to initiate the activation signal if the power supply unit is in an OFF position when the actuatable switching unit is moved to the closed position and the control device is configured to initiate the deactivation signal if the power supply unit is in an ON position when the actuatable switching unit is moved to a closed position.

2. The household appliance of claim 1, constructed in the form of a household dishwasher.

3. The household appliance of claim 1, wherein the switching unit has at least one self-holding contact circuit, which is connected for signal transmission at least to the on switch and the control device.

4. The household appliance of claim 3, wherein the self-holding contact circuit is connected to the on switch in such a manner that the self-holding contact circuit is switchable to a self-holding state.

5. The household appliance of claim 3, further comprising a controller actuatable by the control device and operably connected to the self-holding circuit.

6. The household appliance of claim 3, wherein the self-holding circuit has at least one relay or flipflop.

7. The household appliance of claim 6, wherein the flipflop is an RS flipflop.

8. The household appliance of claim 1, wherein the on switch is configured as a microswitch.

9. The household appliance of claim 1, wherein the on switch is configured for operation by an operator.

10. The household appliance of claim 1, wherein the control device is configured to deactivate the household appliance.

11. The household appliance of claim 1, wherein the on switch is constructed to generate the deactivation signal by double switching actuation of the on switch.

12. The household appliance of claim 1, further comprising an off switch configured to deactivate at least the display unit, wherein the on switch and the off switch are connected in a parallel manner.

13. The household appliance of claim 12, wherein the switching unit has at least one self-holding contact circuit, which is connected for signal transmission at least to the on switch and the control device, said self-holding circuit being connected to the off switch in such a manner that the off switch is switchable to an open state.

14. The household appliance of claim 12, wherein an equally high electrical voltage is present at the on switch and the off switch.

15. The household appliance of claim 12, wherein the power supply unit is configured to form a series circuit with the on switch and the off switch.

16. The household appliance of claim 15, wherein the power supply unit supplies the control device with electrical energy.

17. The household appliance of claim 15, wherein the power supply unit supplies the operating display unit with electrical energy.

* * * * *